United States Patent [19]

Sunnen et al.

[11] Patent Number: 4,524,549

[45] Date of Patent: Jun. 25, 1985

[54] HONING HEAD CONSTRUCTION

[75] Inventors: Robert M. Sunnen, Frontenac; Morton B. Estes, St. Louis County, both of Mo.

[73] Assignee: Sunnen Products Company, St. Louis, Mo.

[21] Appl. No.: 671,040

[22] Filed: Nov. 15, 1984

Related U.S. Application Data

[63] Continuation of Ser. No. 414,472, Sep. 2, 1982, abandoned.

[51] Int. Cl.[3] ..... B24B 33/02

[52] U.S. Cl. ..... 51/347; 51/351

[58] Field of Search ..... 51/330, 331, 338, 339, 51/340, 343, 344, 345, 347–352

[56] References Cited

U.S. PATENT DOCUMENTS

| | | | |
|---|---|---|---|
| 1,698,590 | 1/1929 | Harter | 51/351 |
| 1,922,202 | 8/1933 | Hall et al. | 51/343 |
| 1,929,613 | 10/1933 | Sunnen | 51/347 |
| 2,002,649 | 5/1935 | Sunnen | 51/347 |
| 2,023,082 | 12/1935 | Kem et al. | 51/347 |
| 2,532,682 | 12/1950 | Sunnen | 51/338 |
| 3,216,155 | 11/1965 | Sunnen | 51/347 |

*Primary Examiner*—Robert P. Olszewski

*Attorney, Agent, or Firm*—Haverstock, Garrett & Roberts

[57] ABSTRACT

A honing mandrel having six circumferentially spaced work engaging members thereon including a body portion with a pinion gear rotatably mounted therein, a pair of opposed honing assemblies and a pair of opposed guide assemblies each having rack gear members extendable into transverse body bores for cooperating with the pinion gear, each of the honing assemblies having two circumferentially spaced work engaging honing members thereon, and each of the guide assemblies having a single work engaging guide member thereon, the honing members on the honing assemblies moving on chords of a cylindrical work surface during expansion and contraction thereof, and the guide members on the guide assemblies in one embodiment moving on chords of the work surface during expansion and contraction thereof and in another embodiment moving on or adjacent to a diameter of the work surface during expansion and contraction thereof. In the embodiment where the guide members move on or adjacent to a diameter of the work surface the invention further includes modifying the rack gear teeth on the rack gears associated with the honing assemblies relative to the rack gear teeth on the rack gears associated with the guide members to maintain the honing members and the guide members on the same cylindrical surface during expansion and contraction thereof.

15 Claims, 6 Drawing Figures

HONING HEAD CONSTRUCTION

Continuation of Ser. No. 414,472, Sept. 2, 1982, now abandoned.

PRIOR ART

It has been common practice in the past to construct honing heads or honing mandrels having body portions with a central pinion gear rotatably mounted therein, and wherein a plurality, usually four, work engaging assemblies are mounted for radial movement on the body, and each includes rack gear portions which cooperatively engage the pinion gear and work engaging portions which engage a work surface to be honed. Typical of such constructions are the constructions shown in Sunnen U.S. Pat. Nos. Re. 18,763; 1,929,613; 1,946,041; 1,982,836; 2,002,649; 2,020,589; 2,040,281 and 3,378,962. In the prior art constructions, it has been the usual practice to use a symmetrical arrangement of the work engaging members, usually arranged in opposed pairs, wherein one of the pairs is formed by assemblies with honing stones thereon and the other opposed assemblies have relatively non-abrasive work engaging members or guide members thereon. In the prior art symmetrical constructions all of the work engaging assemblies are moved radially at the same rate, by the same pinion gear, and by rack gears having identical teeth to advance all of the work engaging members equally into engagement with the work surface or to equally retract all of the work engaging members in order to facilitate installing and removing the honing head from the work. Furthermore, in the conventional constructions it has been the usual practice to have a single stone member or a single guide member mounted on each of the work engaging assemblies and to have the stone assemblies arranged in a diametrically opposed pair and to have the guide assemblies arranged in a diametrically opposed pair at locations on the work surface circumferentially spaced between the stone assemblies. To some extent the known constructions have limited the rate at which stock can be removed because of the limited amount of power that can be effectively applied to the honing assemblies against the work surface. In order to increase the cutting rate by enabling greater power to be applied, it has been proposed to mount two circumferentially spaced stone members such as two vitrified honing stones on each of the work engaging stone assemblies. Stones mounted in this manner are currently used to hone bores which have interruptions in them such as splines and keyways. These honing devices also have two circumferentially spaced guide members on each of the diametrically opposed guide assemblies so that such constructions are symmetrical. In the prior art constructions the work engaging stone and guide members have been mounted on one side of one piece relatively rigid backing members which have rack gears attached to their opposite sides. However, it is discovered that such constructions generate substantial objectionable noise, vibration and chatter, and these undesirable conditions increase especially when operated with relatively heavy pressure placed on the work engaging members.

The present construction overcomes these and other disadvantages and shortcomings of the known constructions by teaching a mandrel construction having two diametrically opposed honing assemblies each having a pair of circumferentially spaced stones mounted thereon, and two diametrically opposed guide assemblies positioned circumferentially between the stone assemblies, each guide assembly having a single work engaging member mounted thereon, all four assemblies being driven by the same pinion gear. In such a construction the stones on each stone assembly are approximately equally spaced circumferentially on opposite sides of the diameter on which the opposed stone assemblies move and the work engaging guide members may be mounted in different positions including in a forward or rearward position corresponding to the positions of the stones on the stone assemblies or at some position therebetween including on or approximately on the diameter on which the opposed guide assemblies move. It is also found that it is preferred to use an assembly construction for the stone and guide assemblies that is similar to the constructions shown in Sunnen U.S. patent application Ser. No. 314,856, filed Oct. 26, 1981, now abandoned in favor of continuation application Ser. No. 545,120, filed Oct. 26, 1983 and assigned to applicants' assignee. The assembly constructions shown in the pending case all include a master stone holder member, usually of hardened steel and a member attached thereto, usually of some material such as zinc to which the stones are attached. In the case of the guide assemblies the work engaging portions may also be of zinc attached directly to hardened steel master holders. It has been discovered that such a construction using double stone and single guide assemblies substantially reduces the noise, vibration and chatter associated with previous designs and achieves substantially improved honing accuracies and faster stock removal rates.

However, certain of such designs including those where the stones and guides are located at different positions on their respective assemblies relative to the diameter on which the assemblies move present difficulties in maintaining all of the work engaging members engaged with a work surface. This is especially so if such a device is to be used to hone over a substantial range of diameters or over substantially different diameters, and especially when the guide members are to be located closer to the diameter of the work surface or bore on which the respective assemblies move than is true of the stone members on the stone assemblies. This is because the single guide members located on such guide assemblies will move radially at a somewhat faster rate than the stone members which move on chords relative to the work surface. To overcome this difficulty so that all six work engaging members including the four stones and the two guides remain engaged with the work surface at all times over a substantial range of diameters, certain forms of the present construction require the use of rack gear teeth for the rack gears associated with the stone assemblies that are somewhat more widely spaced, have a greater pitch, than the teeth of the rack gears associated with the guide assemblies, and this will be true even though all four of the assemblies are driven by the same centrally located pinion gear. The use of different pitch or spacing of the gear teeth on the rack gears associated with the stone and guide assemblies enables the use of a construction having six work engaging members where all of the members move relative to the work surface at the same effective rate to enable all of the work engaging members to remain engaged at all times with the work surface.

SUMMARY OF THE INVENTION

It is therefore a principal object of the present invention to increase the honing rate and honing accuracy and reduce the noise of pinion driven honing devices.

Another object is to teach the construction of a pinion driven honing mandrel having six circumferentially spaced work engaging portions.

Another object is to teach the use of a honing mandrel having six work engaging members, at least some of which are mounted on assemblies formed by master holders with work engaging members attached to separate members attached to the master holders.

Another object is to teach the use of relatively resilient master holders for use under work engaging guides to provide some flexing action therefor.

Another object is to teach the use of several different pitch or spaced rack gear teeth for the rack gears used on the different kinds of work engaging assemblies on a honing device including assemblies having different constructions driven by a common pinion gear so as to maintain all of the work engaging members on the device engaged with a work surface over a relatively wide range of operating diameters.

Another object is to reduce noise, vibration and chatter associated with honing devices having pinion driven work engaging assemblies.

Another object is to teach the construction of a honing mandrel having opposed radially movable honing assemblies each having circumferentially spaced work engaging portions and opposed radially movable guide assemblies each having one work engaging guide portion, and rack gear members on each of the honing and guide assemblies for engaging a central pinion gear, some of the teeth on the rack gears associated with at least one set of opposed assemblies being modified with respect to the teeth on the other set of opposed assemblies so as to maintain the the work engaging portions for all of the assemblies effectively on the same cylindrical area over a predetermined range of radial movement of the assemblies.

Another object is to provide an improved honing mandrel with pinion driven work engaging assemblies that can be used on existing honing machines without requiring modification thereof.

Another object is to provide an improved honing device that can be operated by persons having relatively little skill and training.

Another object is to modify the tooth construction on rack gear members engageable with a pinion gear in order to change the rate of movement of the modified rack gears for movements of the pinion gear.

Another object is to teach the construction of a honing mandrel having radially movable honing assemblies and guide assemblies mounted thereon, which mandrel includes means to change the rate of radial movement of the honing assemblies relative to the rate of radial movement of the guide assemblies to maintain the work engaging portions thereof approximately on the same cylindrical surface over a predetermined range of diameters.

Another object is to reduce the effective rate of expansion of the work engaging guide members relative to the work engaging stone assemblies on a honing mandrel, particularly on a mandrel used to hone relatively fine surface finishes so as to provide the option of maintaining the guide members under less pressure against the work surface than the stone members.

These and other objects and advantages of the present invention will become apparent after considering the following detailed specification of preferred embodiments thereof in conjunction with the accompanying drawings, wherein:

DESCRIPTION OF THE PREFERRED EMBODIMENTS

Figure 1:
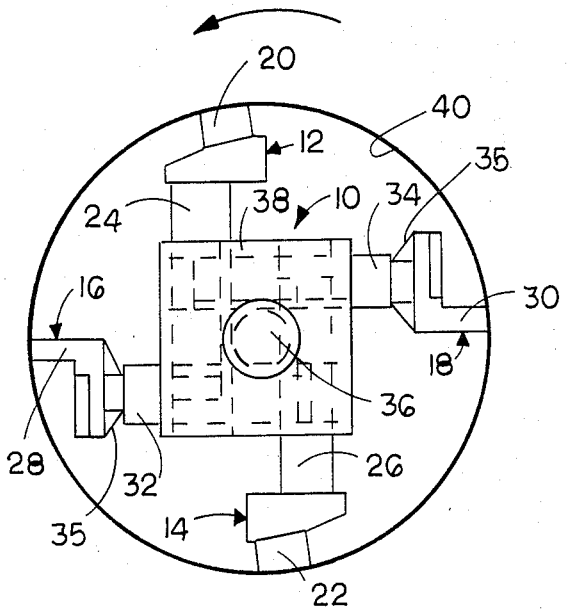
FIG. 1 PRIOR ART
FIG. 1 is a cross-sectional view through a symmetrical mandrel assembly having pinion driven work engaging members of conventional construction.

Referfing to the drawings more particularly by reference numbers, number 10 in FIG. 1 identifies a symmetrical honing mandrel of conventional construction, which mandrel includes two similar diametrically opposite honing assemblies 12 and 14 and two similar diametrically opposite guide assemblies 16 and 18. The honing assemblies 12 and 14 include respective honing stones 20 and 22 and respective rack gear members 24 and 26. The guide assemblies 16 and 18 include respective work engaging relatively non-abrasive members 28 and 30 and respective rack gears 32 and 34. The rack gears 32 and 34 on the guide assemblies may be connected to the work engaging guide members in such a way that spring means such as the springs 35 of FIG. 1, urge the guide members toward the work surface during operation. The rack gears 24, 26, 32, and 34 all have similar rack gear teeth which cooperatively engage the teeth of a centrally located pinion gear 36 mounted in mandrel body 38. The honing mandrel 10 is operated by positioning it in a work surface such as in the work surface 40. This is done when the work engaging members 20, 22, 28, and 30 are in retracted positions. During a honing operation the pinion gear 36 is rotated in the body 38 to move the work engaging members radially outwardly into engagement with the work surface 40, and pressure is maintained on the work engaging members by maintaining rotational force on the pinion gear 36. In the usual prior art construction the stone assemblies 12 and 14 are diametrically opposite to each other and the guide assemblies 16 and 18 are likewise diametrically opposite to each other and usually are also at right angles to the stone assemblies. Such a symmetrical balanced construction has been used for many years. For some purposes the four contact element construction 10, as described, has certain shortcomings and disadvantages including being limited as to the amount of honing pressure that can be efficiently applied to the work engaging members and particularly to the stones 20 and 22. This limit on the honing pressure limits the rate at which material can be removed from a bore.

Figure 2:
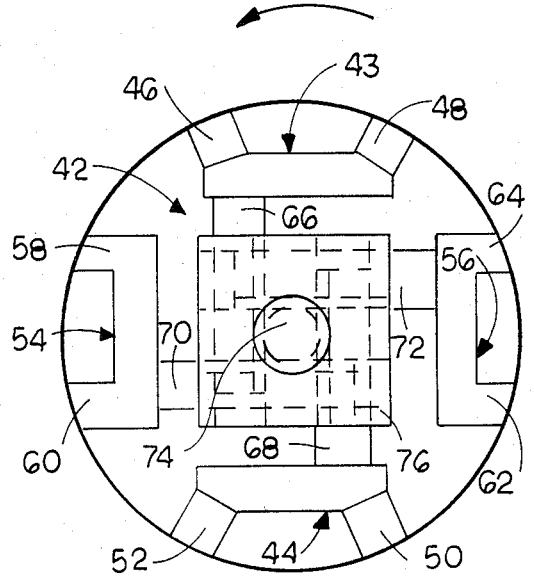
FIG. 2 is a cross-sectional view through another symmetrical mandrel construction having a different form of work engaging honing and guide members mounted thereon.

FIG. 2 shows another balanced symmetrical mandrel construction 42 in which two opposite hone assemblies 43 and 44 each has two circumferentially spaced stones 46 and 48 and 50 and 52 arranged as shown, and each of the guide assemblies 54 and 56 has two circumferentially spaced work engaging guide members 58 and 60 and 62 and 64 making for an eight work engaging element construction. Each of the four assemblies also has at least two spaced rack gears such as the respective rack gears 66, 68, 70, and 72, and all of the rack gears have similar teeth that mate with the elongated teeth on pinion gear 74 rotatable in mandrel body 76. One of the advantages of the construction 42 as compared to the construction 10 is that by having two work engaging members on each assembly it is able to hone bores that have interruptions in them such as interruptions formed by splines and keyways. However, the construction shown in FIG. 2 also has an important disadvantage in that it is relatively noisy in operation and this has substantially limited its usefulness.

Figure 3:
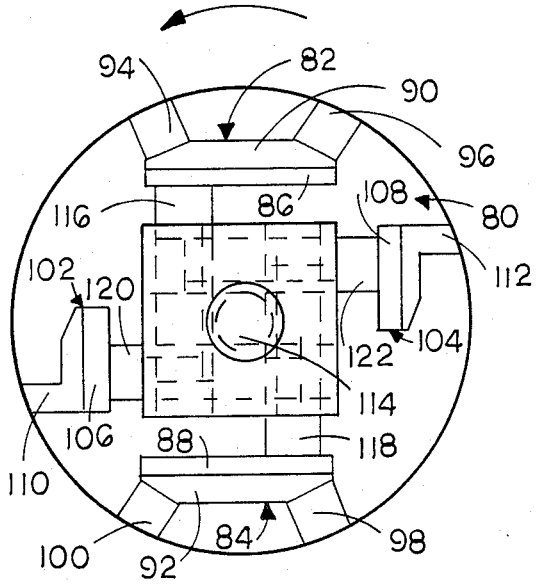
FIGS. 3 and 4 are other cross-sectional views similar to FIG. 2 but showing alternate embodiments of the present invention in which use of the one work engaging guide member on the respective guide assemblies is shown at different alternate positions.

FIG. 3 shows a mandrel 80 constructed according to one embodiment of the present invention. The mandrel 80 differs from the mandrels 10 and 42 in several important respects including having opposed stone assemblies 82 and 84 which are formed with respective master holder portions 86 and 88 of some relatively hard material such as steel and with replaceable mounting members 90 and 92 which are of a material such as zinc for mounting on the master holders. Stone members 94 and 96 and 98 and 100 are attached to the mounting members 90 and 92 as shown. The mandrel 80 also has opposed guide assemblies 102 and 104 each of which also has a master holder portion 106 and 108 and a respective work engaging guide member 110 and 112 mounted thereon. It is important that master holders 106 and 108 are able to flex. This can be accomplished through a number of means, including reducing the area and/or thickness of the master holders. In the mandrel 80 of FIG. 3 the guide members 110 and 112 are shown mounted in forward positions on the respective assemblies corresponding to the positions of the forward stone members 94 and 98. This means that all of the assemblies 82, 84, 102, and 104 can be equally advanced or retracted by the same pinion gear 114 which engages similar rack gears 116, 118, 120, and 122 to maintain all of the work engaging members on the same circle or cylindrical workpiece surface for all honing diameters. It is found that a six element mandrel construction such as the construction 80 operates quietly and accurately and also enables greater loads to be applied to the elements and especially to the stone elements 94, 96, 98 and 100 to increase the rate of stock removal. This in part is due to the six element characteristic and in part due to the use of flexing master holders of the guide assemblies. The use of master holders on honing assemblies and means for attaching the stone mounting members thereon is disclosed in detail in Sunnen application Ser. No. 314,856, now abandoned in favor or continuation application Ser. No. 545,120.

Figure 4:
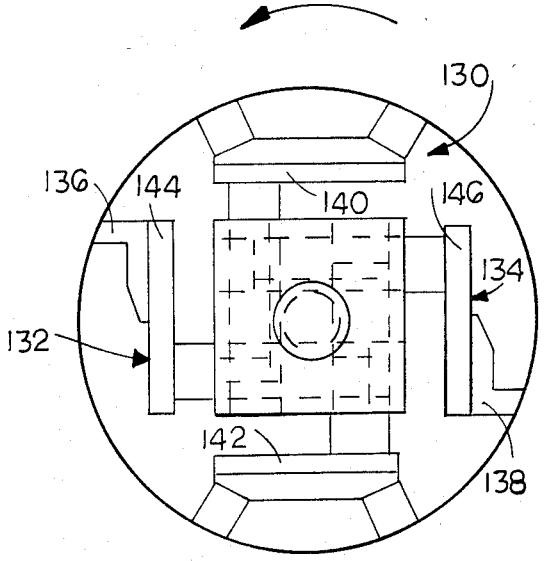

FIG. 4 shows another mandrel embodiment 130 which is similar in construction to the mandrel 80 shown in FIG. 3. The main difference between the mandrel 130 of FIG. 4 and the mandrel 80 of FIG. 3 is in the construction of the single element guide assemblies 132 and 134 which have their respective work engaging guide members 136 and 138 mounted near the trailing rather than near the leading edges thereof. This provides a somewhat more cantilevered construction of the guide members 136 and 138 and is an alternate to the construction of FIG. 3 and provides the possibility for greater movement of the guide assemblies. The cantilever construction of FIG. 4 enables some spring action for the guides, thereby obviating some of the possible stiffness of the construction of FIG. 3 wherein the guide members are in forward positions on the guide assemblies. It is necessary, however, to carefully select a proper material and design for the members that form the guide assemblies in order to accomplish the desired degree of flexing. The construction of FIG. 4, like the construction of FIG. 3, also employs work engaging assemblies that include master holders 140, 142, 144 and 146 with mounting assemblies for the work engaging elements attached thereto as disclosed above and in the copending Sunnen application. The work engaging guide members 136 and 138 are preferably formed of a relatively non-abrasive substance which is characterized by sliding on a work surface rather than abrading it. Typical materials that can be used for the guide members include, zinc, aluminum, brass, bronze, plastic and wood.

Figure 5:
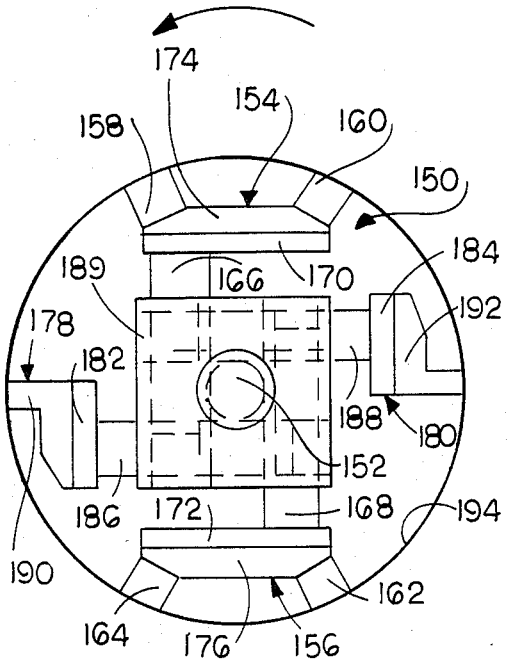
FIG. 5 is a cross-sectional view through a honing mandrel constructed according to another embodiment of the present invention; and, FIG. 6 is a fragmentary cross-sectional view of the mandrel of FIG. 5 showing several different positions of a work engaging honing and guide assembly in solid and in dotted outline, the guide assembly being shown offset to overlay one of the honing assemblies to illustrate movement of the work engaging members on the device over a range of diameters.

FIG. 5 shows a mandrel construction 150, which also has six contact elements on it rather than four or eight as in the constructions of FIGS. 1 and 2. The mandrel 150 has its work engaging elements powered by a single centrally located pinion gear 152 which drives two oppositely facing honing assemblies 154 and 156 each of which has two spaced stones 158 and 160 and 162 and 164 mounted thereon. Each of the honing assemblies 154 and 156 also has at least two similar rack gears 166 and 168 mounted thereon. The rack gears 166 and 168 have identical teeth which mesh with the elongated teeth on the pinion gear 152. The stone assemblies 154 and 156 are preferably constructed having master stone holders 170 and 172 with stone support members 174 and 176 attached thereto as shown.

The mandrel 150 also has two opposed guide assemblies 178 and 180, each of which has a respective master holder 182 and 184 connected to rack gears 186 and 188 on one side and a single work engaging member or guide shoe 190 and 192 mounted on the opposite side. However, even though the rack gears 166 and 168 on the honing assemblies and the rack gears 186 and 188 on the guide assemblies mesh with the same pinion gear 152, the teeth on the rack gears for the honing and guide assemblies have different pitches or spacing so that during rotation of the pinion gear 152 the stone assemblies 154 and 156 will move outwardly relative to the mandrel body 189, and relative to the work surface 194, at a faster rate than the guide assemblies. This is necessary, as will be explained in connection with FIG. 6, because of the location of the work engaging guide members 190 and 192 on their respective guide assemblies 178 and 180 as compared to the location of the work engaging members or stones on the respective honing assemblies 154 and 156. By having the pitch or spacing of the teeth on the rack gears 186 and 188 for the guide assemblies 178 and 180 closer together than the pitch or spacing of the teeth on the rack gears 166 and 168 for the honing assemblies 154 and 156 means that the guide assemblies will expand or contract, or move radially outwardly or inwardly, at a slower rate than the honing assemblies. Nevertheless, it is still important that the master holders in the guide assemblies are able to flex or have some resilience as referred to in the discussion regarding FIG. 3. It has been found that by proper selection of the spacing of the rack gear teeth with a six element contact construction such as shown in FIG. 5 and the proper flexing of the guide assemblies that the device also operates with substantially less noise and chatter than conventional constructions and is able to hone more accurate surfaces than the constructions shown in FIGS. 1 and 2.

Figure 6:
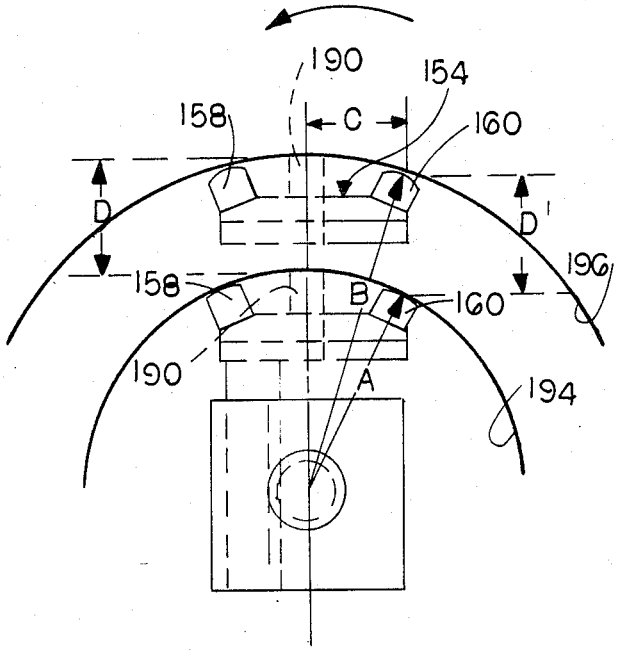

The reason the gear tooth spacing for the rack gears 186 and 188 associated with the guide assemblies 178 and 180 must be less than the spacing of the gear teeth for the rack gears 166 and 168 associated with the honing assemblies 154 and 156 will be understood by reference to FIG. 6 wherein two of the work engaging assemblies, one a stone assembly 154 and the other a guide assembly 178, are shown superimposed on each other and each is shown in two different positions. In the inner or more contracted positions of the assemblies 154 and 178 the honing stones 158 and 160 are shown positioned extending to the workpiece surface 194 which is shown as being a circle of relatively small diameter such as three inches. In this position the guide member 190 on the guide assembly 178 is also shown located on the same circular workpiece surface 194. If the rack gears 166 and 186 for the honing and guide assemblies had identical teeth, the stones 158 and 160, which do not move on a diameter when expanding and contracting as does the guide member 190, but move on chords of the expanding circle, are not able to keep up with the diameter established by the guide members during expansion. This means that the stones would move progressively further out of engagement with the work surface as the work surface expands, and soon only the guide member 190 (and 192) would be in engagement therewith, an obviously totally unsatisfactory condition. To compensate for this and to maintain the stones engaged with the work, the teeth on one or on both sets of rack gears 166, 168, 186 and 188 are modified so that all of the work engaging elements will remain approximately on the same circular work surface over a range of radial movement during rotation of the pinion gear 152. In the preferred situation, the teeth on the rack gears 166 and 168 for the stone assemblies 154 and 156 are constructed to be somewhat further apart than the rack gear teeth on the rack gears 186 and 188 associated with the guide assemblies 178 and 180. This is done so that for a given rotation of the pinion gear 152, the honing assemblies 154 and 156 will move further than the guide assemblies 178 and 180. This is necessary because the stones 158, 160, 162 and 164 are mounted for movement on chords of the work surface, as aforesaid, and therefore the stone assemblies on which they are mounted must move further radially, i.e., at a faster rate, than the guide assemblies 178 and 180 which have their work engaging guide members moving on a diameter of the work surface in order to maintain the stones 158, 160, 162 and 164 on the same cylindrical surface as the guide members 190 and 192 during expansion. The same principles apply during contraction.

In FIG. 6 the leads A, B, C, D and D′ are included to represent distances that can be used to mathematically explain the error that needs to be corrected by modifying the rack gear teeth in the manner indicated so that movements of the stones 158, 160, 162 and 164 relative to the work surface keep pace with movements of the guide members 190 and 192 in going from one honing diameter, such as from a three inch honing diameter, to a four inch honing diameter. The distance from the center of the left stone 158 to the center of the right stone 160 has been selected for the example to be $1\frac{3}{4}$ inches. It is also assumed that the stones 158 and 160 are infinitely thin so that they touch the bore or workpiece surface at their centers only when the stone assembly 154 is in its various operating positions. In an actual situation this will generally not be the case. In the example shown:

A=1.500″,
B=2.000″, and
C=0.875″
Therefore:
D=B−A=0.500″, and $$D' = \sqrt{B^2 - C^2} - \sqrt{A^2 - C^2}$$

$$= \sqrt{2.000^2 - 0.875^2} - \sqrt{1.500^2 - 0.875^2}$$

$$= 1.7984 - 1.2183 = 0.5801''$$

The radial error is the space between the center of the stone 160 (or 158) and the outer circle or workpiece assuming all assemblies have rack gears with identical teeth. This difference is the difference between D′ and D, or D′−D=0.5801−0.5000=0.0801″. The radial error of 0.0801″ is the error that occurs if the stone assembly 154 is moved one half inch radially, that is, if the center point between the stones 158 and 160 moves one half inch radially outwardly, while the guide member or shoe 190 is also moving radially outwardly one half inch but on a diameter of the workpiece surface. It can be seen that when the assembly 154 has moved one half inch radially outwardly the stones 158 and 160 will be spaced 0.0801″ from the outer circle or work surface 196 while the guide member 190 extends to the outer circle 196.

In the table which follows the lefthand column is in equal 0.1″ increments of bore diameter in the range from three to four inches, and the righthand column shows the amount of radial error as defined above for an infinitely thin honing stone mounted on an assembly such as the assemblies 154 and 156 when the assembly moves radially outwardly by one half of the increments in the lefthand column.

| DIAMETER (.10 inch increments) | RADIAL ERROR OF EACH STONE |
|---|---|
| 3.000 | .0000 |
| 3.100 | .0111 |
| 3.200 | .0212 |
| 3.300 | .0305 |
| 3.400 | .0392 |
| 3.500 | .0472 |
| 3.600 | .0547 |
| 3.700 | .0616 |
| 3.800 | .0682 |
| 3.900 | .0743 |
| 4.000 | .0801 |

It can be seen that the radial error does not change in a linear relationship with radial movements of the honing assemblies, and that after the stone assembly 154 has moved radially one half inch the total radial error will be 0.0801 inch for each stone. Because of this, some means must be provided to move the honing assemblies 154 and 156 at a faster rate radially than the guide assemblies 178 and 180 if all of the assemblies are to remain on the work surface at all times and in all positions within the range thereof. This can be accomplished, as indicated, by increasing the spacing between the gear teeth on the rack gears 166 and 168 associated with the stone assemblies 154 and 156 relative to the spacing of the rack gear teeth on the rack gears 186 and 188 associated with the guide assemblies, or by decreasing the spacing between the rack gear teeth on the guide assemblies relative to the spacing between the rack gear teeth associated with the stone assemblies or by a combination of both of these. For a given pinion gear 152 there is a certain ideal spacing for the rack gear teeth. Thus, if the rack gear tooth spacing is increased or decreased somewhat from the ideal, some adverse effect from the most desired operating condition will take place but within limits this can be tolerated. To ameliorate this condition involves a compromise between the spacing of the teeth on the honing and guide assemblies. The compromise should take into account that the spacings should not be so such as to cause excessive binding between any of the rack gear teeth and the teeth of the pinion. In an actual construction, it is usually preferred to achieve the desired result by adjusting the tooth spacing on both sets of the rack gears. It is also possible to vary the pitch of the teeth on the individual rack gears in order to more fully compensate for the nonlinearity of the radial error.

Modifying the teeth on the rack gear members in the manners indicated provides a very satisfactory operating condition for a honing mandrel that has six work engaging members on it where some of the members move on or near a diameter and others move on chords of the expanding work surface, and it has been found that mandrels so constructed hone to better accuracy, operate relatively quietly and with less vibration and chatter, and produce a better wear condition for the guide members. However, as indicated, there are some limitation as to the range of diameters over which a honing mandrel such as described herein can operate. It has been found that a typical mandrel construction in a midrange of size can operate over a range of diameters from about an inch to about an inch and a half very satisfactorily, but this will vary as the mandrel size is increased or decreased.

Thus there has been shown and described a mandrel construction having six circumferentially spaced work engaging members including two multi-element honing assemblies and two single element guide assemblies arranged in opposed work engaging relationship, which mandrel fulfills all of the objects and advantages sought therefor. It will be apparent to those skilled in the art, however, that many changes, modifications, variations and other uses and applications for the subject mandrel are possible, and all such changes, modifications, variations and other uses and applications which do not depart from the spirit and scope of the invention are deemed to be covered by the invention which is limited only by the claims which follows.

What is claimed is:

1. A honing mandrel having six circumferentially spaced work engaging members thereon comprising a body portion having a bore extending therethrough, a pinion gear mounted for rotational movement in the bore, at least four sets of spaced transverse body bores, the bores in each set extending through the body in positions to intersect the bore in which the pinion gear is located at spaced locations therealong, said four sets of transverse bores being arranged in first and second angularly related opposed sets on the body portion, a pair of opposed honing assemblies each including an elongated member having opposite surfaces, a set of rack gears extending from one of the opposite surfaces on each honing assembly at locations for positioning in the respective bore sets of the first opposed sets whereby the honing assemblies are arranged in opposed relation on opposite sides of the body portion, each of said rack gears having rack gear teeth thereon for engaging the pinion gear, two circumferentially spaced honing members mounted on the other opposite surface of each elongated member to engage a work surface at circumferentially spaced locations thereon, a pair of opposed guide assemblies each including an elongated support member having opposite surfaces, a set of rack gears extending from one of the opposite surfaces of each support member at locations for positioning in the respective bore sets of the second opposed sets whereby the guide assemblies are arranged in opposed relation on opposite sides of the body portion at locations intermediate circumferentially between the honing assemblies for movement in diametrically opposite directions, each of said rack gears on the guide on the guide assemblies having rack gear teeth thereon engageable with the pinion gear, and a single work engaging guide member mounted on the opposite surface of each elongated support member, the rack gears for the respective guide assemblies and the respective work engaging guide member thereon being located on the respective guide assemblies on opposite sides of the diameters along which the respective guide assemblies move when the pinion gear rotates, the two work engaging honing members on each of the honing assemblies and the work engaging guide member on each of the guide assemlies establishing said six circumferentially spaced work engaging members on the honing mandrel.

2. The honing mandrel of claim 1 wherein the elongated member of each of said honing assemblies includes a first elongated portion of a relatively hard material attached to the respective set of rack gears, a second elongated portion to which the circumferentially spaced honing members are attached, and means for detachably connecting each of the second elongated portions of the honing assemblies to the respective first elongated portions thereof.

3. The honing mandrel of claim 1 wherein the elongated support member of each guide assembly includes a first elongated portion which is capable of flexing in relation to the respective set of attached rack gears, and a second elongated portion formed of a relatively nonabrasive material that is characterized by being more likely to slide on a work surface than to abrade it, said second elongated portion including the work engaging guide member, and means for detachably connecting each of the second elongated portions of the guide assemblies to the respective first elongated portions thereof.

4. The honing mandrel of claim 3 wherein the work engaging guide members on the respective guide assemblies are located on the respective guide assemblies at positions thereon that correspond to the positions of one of the circumferentially spaced honing members on the respective honing assemblies.

5. A honing device comprising an elongated body portion having an elongated body bore extending therethrough, a pinion gear mounted for rotational movement in the elongated body bore, parallel first and second sets of spaced transverse body bores intersecting the elongated body bore at spaced locations therealong, parallel third and fourth sets of transverse body bores through the body portion intersecting the elongated body bore at locations angularly related to the first and second sets of transverse bores, a pair of honing assemblies each including an elongated member having opposite surfaces, a set of rack gears extending from corresponding ones of the opposite surfaces on each honing assembly for extending into the bores of the respective first and second sets, the rack gears on said respective honing assemblies having gear teeth for cooperatively engaging the pinion gear on opposite sides thereof whereby the honing assemblies move in diametrically opposite directions on the body portion under control of movements of the pinion gear, two circumferentially spaced honing members mounted on the other opposite surface of each elongated member of each honing assembly at positions to engage a work surface at circumferentially spaced locations, the honing members on each honing assembly being located approximately equal distance on opposite sides of the diameter on which the honing assemblies move, a pair of guide assemblies each including an elongated support member having opposite surfaces, a set of rack gears extending from corresponding ones of the opposite surfaces on each guide assembly, the rack gears on one of the guide assemblies extending into the third set of transverse body bores, and the rack gears on the other guide assembly extending into the fourth set of transverse body bores, each of said rack gears on said guide assemblies having teeth for cooperatively engaging the pinion gear on opposite sides thereof whereby the guide assemblies move in diametrically opposite directions on the body portion at locations intermediate circumferentially between the honing assemblies and under control of movements of the pinion gear, each of said guide assemblies having a single work engaging guide member mounted for movement in respective opposite directions under control of rotation of the pinion gear, the rack gears for the respective work engaging guide assemblies and the respective work engaging guide member thereon being located on opposite sides of the diameters a long which the respective guide assemblies move when the pinion gear rotates, the two work engaging honing members on each of the honing assemblies and the work engaging guide member on each of the guide assemblies establishing six circumferentially spaced and simultaneously radially movable work engaging members on the honing device.

6. The honing device of claim 5 wherein the work engaging guide members on the respective guide assemblies are located on the respective guide assemblies at positions that correspond to the position of one of the circumferentially spaced honing members on the honing assemblies.

7. The honing device of claim 5 wherein the elongated support member on each of the guide assemblies includes a master holder member formed of a material capable of flexing somewhat relative to the associated rack gears attached thereto.

8. The honing device of claim 7 wherein the master holder members are formed of steel that is relieved to facilitate flexing and to increase resiliency.

9. A honing mandrel comprising a body portion having a bore extending therethrough, a pinion gear mounted for rotational movement in the bore, four sets of spaced transverse body bores, the bores in each set extending through the body in positions to intersect the bore in which the pinion gear is located at spaced locations therealong, said four sets of transverse bores being arranged in first and second angularly related opposed sets on the body portion, a pair of opposed honing assemblies each including an elongated member having opposite surfaces, a set of rack gears extending from one of the opposite surfaces on each honing assembly at locations for positioning in the respective bore sets of the first opposed sets whereby the honing assemblies are arranged in opposed relation on opposite sides of the body portion, each of said rack gears having rack gear teeth thereon for engaging the pinion gear, at least two circumferentially spaced honing members mounted on the other opposite surfaces of each elongated member to engage a work surface at circumferentially spaced locations thereon, a pair of opposed guide assemblies each including an elongated support member having opposite surfaces, a set of rack gears extending from one of the opposite surfaces of each support member at locations for positioning in the respective bore sets of the second opposed sets whereby the guide assemblies are arranged in opposed relation on opposite sides of the body portion at locations intermediate circumferentially between the honing assemblies, each of said rack gears on the guide assemblies having rack gear teeth thereon engageable with the pinion gear, and a work engaging guide member mounted on the opposite surface of each elongated support member, the work engaging guide members being located on their respective assemblies to move during expansion and contraction of the mandrel closer to a diameter thereof than the honing members on the respective honing assemblies, at least some of the rack gear teeth on the rack gears associated with the honing assemblies being spaced further apart than some of the rack gear teeth on the rack gears associated with the guide assemblies.

10. A honing device comprising an elongated body portion having an elongated body bore extending therethrough, a pinion gear mounted for rotational movement in the elongated body bore, parallel first and second sets of spaced transverse body bores intersecting the elongated body bore at spaced locations therealong, parallel third and fourth sets of transverse body bores through the body portion intersecting the elongated body bore at locations angularly related to the first and second sets of transverse bores, a pair of honing assemblies each including an elongated member having opposite surfaces, a set of rack gears extending from corresponding ones of the opposite surfaces on each honing assembly for extending into the bores of the respective first and second sets, the rack gears on said respective honing assemblies having gear teeth for cooperatively engaging the pinion gear on opposite sides thereof whereby the honing assemblies move in diametrically opposite directions on the body portion under control of movements of the pinion gear, at least two circumferentially spaced honing members mounted on the other surface of each elongated member of each honing assembly at positions to engage a work surface at circumferentially spaced locations, the honing members on each honing assembly being located approximately equal distance on opposite sides of the diameter on which the honing assemblies move, a pair of guide assemblies each including an elongated support member having opposite surfaces, a set of rack gears extending from one of the opposite surfaces on each guide assembly, the rack gear members on one of the guide assemblies extending into the third set of transverse body bores, and the rack gears on the other guide assembly extending into the fourth set of transverse body bores, each of said rack gears on said guide assemblies having teeth for cooperatively engaging the pinion gear on opposite sides thereof whereby the guide assemblies move in diametrically opposite directions on the body at locations intermediate circumferentially between the honing assemblies, and under control of movements of the pinion gear, each of said guide assemblies having a work engaging guide member mounted for movement in respective opposite directions under control of rotation of the pinion gear, the work engaging guide members on the opposed guide assemblies being mounted for movement in respective opposite directions substantially on a diameter of the body portion, at least some of the rack gear teeth on the rack gears associated with the honing assemblies being spaced further apart than at least some of the rack gear teeth on the rack gears associated with the guide assemblies.

11. The honing device of claim 10 wherein the pitch of the rack gear teeth on the rack gears associated with the honing assemblies varies along the length thereof to compensate for non-linearity between radial movements of the work engaging members on the honing assemblies relative to radial movements of the work engaging guide members on the guide assemblies.

12. The honing device of claim 10 wherein the pitch of the rack gear teeth on the rack gears associated with the guide assemblies varies along the length thereof to compensate for non-linearity in the radial movement of the work engaging members on the honing assemblies relative to the radial movements of the work engaging members on the guide assemblies.

13. A honing device comprising an elongated body portion having an elongated body bore therethrough, a pinion gear mounted for rotational movement in the elongated body bore, parallel first and second sets of spaced transverse body bores intersecting the elongated body bore at spaced locations therealong, parallel third and fourth sets of transverse body bores through the body portion intersecting the elongated body bore at locations angularly related to the first and second sets of transverse bores, a pair of honing assemblies each including an elongated member having opposite surfaces, a set of rack gears extending from corresponding ones of the opposite surfaces on each honing assembly for extending into the bores of the respective first and second sets, the rack gears on said respective honing assemblies having gear teeth for cooperatively engaging the pinion gear on opposite sides thereof whereby the honing assemblies move in diametrically opposite directions on the body portion under control of movements of the pinion gear, at least two circumferentially spaced honing members mounted on the other opposite surface of each elongated member of each honing assembly at positions to engage a work surface at circumferentially spaced locations, the honing members on each honing assembly being located approximately equal distance on opposite sides of the diameter on which the honing assemblies move, a pair of guide assemblies each including an elongated support member having opposite surfaces, a set of rack gears extending from one of the opposite surfaces on each guide assembly, the rack gear members on one of the guide assemblies extending into the third set of transverse body bores, and the rack gears on the other guide assembly extending into the fourth set of transverse body bores, each of said rack gears on said guide assemblies having teeth for cooperatively engaging the pinion gear on opposite sides thereof whereby the guide assemblies move in diametrically opposite directions on the body portion at locations intermediate circumferentially between the honing assemblies, and under control of movements of the pinion gear, each of said guide assemblies having a work engaging guide member mounted for movement in respective opposite directions under control of rotation of the pinion gear, the work engaging guide members on the opposed guide assemblies being mounted for movement in respective opposite directions substantially on a diameter of the body portion, the rack gear teeth associated with the honing assemblies being modified to increase the rate of radial movement of the honing assemblies relative to the rate of radial movement of the guide assemblies.

14. The honing device of claim 13 wherein the spacing of the gear teeth on the rack gears associated with the honing assemblies is increased from a normal condition relative to the gear teeth of the pinion gear to increase the rate of movement of the honing assemblies during rotation of the pinion gear.

15. The honing device of claim 13 wherein the spacing of the rack gear teeth of the rack gears associated with the guide assemblies is reduced relative to a normal condition relative to the gear teeth of the pinion gear to retard the rate of movement of the guide assemblies during rotation of the pinion gear.

* * * * *

UNITED STATES PATENT OFFICE

CERTIFICATE OF CORRECTION

Patent No. 4,524,549 Dated June 25, 1985

Inventor(s) Robert M. Sunnen and Morton B. Estes

It is certified that error appears in the above-identified patent and that said Letters Patent are hereby corrected as shown below:

Column 4, line 33 "Referfing" should be --Referring--.

Column 10, line 25 "on the guide" (first occurrence) should be deleted.

Column 10, line 36 "assemlies" should be --assemblies--.

Column 11, line 45 "a long" should be --along--.

Signed and Sealed this

*Twenty-second* Day of *October 1985*

[SEAL]

*Attest:*

DONALD J. QUIGG

*Attesting Officer*

*Commissioner of Patents and Trademarks—Designate*